US005220109A

United States Patent [19]

Commandeur et al.

[11] Patent Number: 5,220,109

[45] Date of Patent: Jun. 15, 1993

[54] DESTRUCTION OF HALOGENATED ORGANIC SPECIES

[75] Inventors: Raymond Commandeur, Vizille; Elie Ghenassia; Bernard Gurtner, both of Grenoble, all of France

[73] Assignee: Atochem, Puteaux, France

[21] Appl. No.: 713,585

[22] Filed: Jun. 11, 1991

Related U.S. Application Data

[63] Continuation of Ser. No. 236,179, Aug. 25, 1988, abandoned.

[30] Foreign Application Priority Data

Sep. 3, 1987 [FR] France ..... 87 12248

[51] Int. Cl.[5] ..... A62D 3/00

[52] U.S. Cl. ..... 588/209; 588/206; 588/207; 210/909; 208/262.5; 423/659

[58] Field of Search ..... 423/654, DIG. 20; 208/262.1, 262.5; 210/909; 588/206, 207, 209

[56] References Cited

U.S. PATENT DOCUMENTS

| | | | |
|---|---|---|---|
| 4,327,027 | 4/1982 | Howard et al. | 208/262.5 |
| 4,351,718 | 9/1982 | Brunelle | 585/864 |
| 4,400,552 | 8/1983 | Pytlewski et al. | 208/262 |
| 4,532,028 | 7/1985 | Peterson | 208/262.5 |
| 4,574,013 | 3/1986 | Peterson | 134/2 |
| 4,632,742 | 12/1986 | Tundo | 210/909 |
| 4,772,758 | 9/1988 | Kaufhold | 208/262.1 |
| 4,776,947 | 10/1988 | Streck et al. | 208/262.1 |
| 4,839,042 | 6/1989 | Tumiatti et al. | 210/194 |
| 5,043,054 | 8/1991 | Halpen et al. | 208/262.5 |

FOREIGN PATENT DOCUMENTS

| | | |
|---|---|---|
| 0225849 | 6/1987 | European Pat. Off. . |
| 0250748 | 1/1988 | European Pat. Off. . |

OTHER PUBLICATIONS

*The Journal of Organic Chemistry*, vol. 44, No. 26, Dec. 21, 1979, pp. 4979–4981.

*Primary Examiner*—Gary P. Straub

*Attorney, Agent, or Firm*—Burns, Doane, Swecker & Mathis

[57] ABSTRACT

Halogenated organic species, e.g., chlorinated or brominated dioxins or dibenzofurans, PCBs, and the like, are consumed by contacting such species, at a temperature of greater than 220° C., with a stoichiometric excess, relative to the halogen content thereof, of at least one alkali metal alcoholate.

17 Claims, No Drawings

DESTRUCTION OF HALOGENATED ORGANIC SPECIES

This application is a continuation of application Ser. No. 07/236,179, filed Aug. 25, 1988, now abandoned.

BACKGROUND OF THE INVENTION

1. Field of the Invention

The present invention relates to a chemical process for the destruction or consumption of halogenated organic materials and, more especially, chlorinated aromatic materials such as, for example, PCBs (polychlorobiphenyls), possibly admixed with unchlorinated organic species.

2. Description of the Prior Art

The removal of PCBs present in dielectric transformer oils or lubricating oils by extraction with methanol has already been proposed to this art (U.S. Pat. No. 4,387,018). The methanol is then separated from the PCBs by distillation and is then recycled. This process enables the quantity of PCB to be reduced by 70%. European Patent Ep 99,951 proposes to treat similar products with sodium dispersed as particles larger than 10 μm. European Patent Application EP 107,404 describes the treatment of a transformer oil containing 652 ppm of PCB with sodium salts of a polyethylene glycol.

The disadvantage of these processes is that they require separations and recycling operations or the handling of sodium. European Patent Application EP 21,294 describes the destruction of dioxins, in particular chlorinated anisoles containing 39.7 ppm of 2,3,7,8-tetrachlorodibenzo-p-dioxin, by reacting these compounds under pressure with sodium methylate in methanol at 160° C. Moreover, a paper by Gyula Pfeifer and Terez Flora in the Hungarian journal, *Magy. Kem. Folyoirat*, 71, (8), 343-6 (1965) explains that sodium methylate can begin to decompose between 120° and 140° C.

SUMMARY OF THE INVENTION

Accordingly, a major object of the present invention is the provision of an improved process for the destruction of contaminating halogenated organic species which is conspicuously much simpler and highly efficient vis-a-vis those techniques to date characterizing the state of this art.

Briefly, the present invention features a process for destroying halogenated organic species, comprising:

(a) contacting such species with at least one alkali metal alcoholate for the time required to convert the organic halides into inorganic halides, (b) wherein the amount of alcoholate is a stoichiometric excess relative to the amount of halogen, and (c) the temperature is above 220° C.

DETAILED DESCRIPTION OF THE PREFERRED EMBODIMENTS OF THE INVENTION

More particularly according to the present invention, the destruction of all halogenated species is comprehended hereby, but more especially species containing chlorine- and/or bromine-substituted aryl compounds. Such species include, for example, chlorinated or brominated dioxins, chlorinated or brominated dibenzofurans, (polychloro)biphenyls, (polybromo)biphenyls, (polybromo)diphenyl ethers, and (polychloro)diphenyl ethers. These compounds may be pure or mixed together, or mixed with unhalogenated organic materials such as polyarylalkanes, or mineral oils.

Although the invention makes it possible to destroy any halogenated material, it is advantageously employed in the case of materials containing less than 1% and preferably less than 1000 ppm by weight of halogen.

Although any alcoholate derived from a monoalcohol, a diol or a triol and from an alkali metal can be employed, including methylates and glycol or polyglycol alcoholates, advantageously sodium, lithium or potassium methylate, ethylate, propylate or isopropylate, or a mixture of such compounds, is used, and preferably sodium methylate.

Advantageously, the alcoholate is added to the halogenated materials or the mixture containing the halogenated materials. Powdered sodium methylate is preferably used. With the stoichiometry being one alcoholate group per atom of halogen to be removed, a quantity of alcoholate in stoichiometric excess is employed. Very good dehalogenation is obtained by employing an excess of 5 to 10 times the stoichiometry. For example, if a mixture contains PCBs in a proportion of 100 ppm, expressed as chlorine, a quantity of sodium methylate of 0.14% is employed.

It is also within the ambit of the invention to add with the alcoholate another product capable of converting organic chlorine into inorganic chlorine, such as, for example, sodium carbonate or another alkaline agent.

Contacting the halogenated organic materials with the alcoholate is advantageously carried out under agitation, for example in a stirred reactor or a packed column, or any other device permitting sufficient agitation for the alcoholate to be well dispersed and to contact the halogenated species for the time required to destroy the latter. The reaction may be carried out continuously or noncontinuously. The reaction kinetics increase with temperature. A temperature of from 220° to 300° C. may be employed; it is preferred to operate at a temperature of from 250° to 290° C. Depending on the physical properties of the products (vapor pressure), the operation is carried out at atmospheric pressure or at higher pressure. The reaction time is a function of the quantities of organic halogen, of temperature, of the quantity of alcoholate, and of the agitation conditions for obtaining good contact between the reactants; it usually ranges from 30 minutes to 10 hours.

The invention is particularly useful for destroying the halogenated aryl compounds present in a mixture, for example an unhalogenated dielectric liquid or a mineral oil containing PCBs. The process of the invention is applicable to this product containing PCBs or other chlorinated products, and the inorganic halogenated products are then separated from the other products, for example by distillation. A mineral oil or a dielectric free from organic chlorine is thus obtained.

An excess of alcoholate is employed to ensure that the dehalogenation is as complete as possible. When a dielectric fluid which contains a few hundred ppm of aromatic chlorinated compounds is treated, the dielectric, the chloride NaCl, the products of conversion of the aromatic chlorinated compounds and the remaining unreacted alcoholate are obtained upon completion of the reaction. It is very convenient to distil this mixture to recover the pure dielectric no longer containing aromatic chlorine. When the alcoholate employed is sodium methylate, it is prudent not to exceed residence times of 12 hours at 295° C. in the distillation apparatus, to avoid a decomposition of the methylate.

The process of the present invention is also employed as an adjunct to a sodium carbonate process. Sodium carbonate is very easy to handle but permits the removal of only aliphatic halogens and of the most labile aryl halogens.

The process of the invention makes it possible to obtain a product with an aryl halogen content of less than 10 ppm. The advantage of this process is that, although applicable to products containing relatively unreactive halogen atoms, it does not require the use of solvents; namely, it suffices to add an alcoholate, for example to the oil containing the PCBs, without it being necessary to add, in addition to the alcoholate, the alcohol corresponding to the alcoholate, as in EP 21,294. This process does not require a preliminary separation of the excess alcoholate, in particular of sodium methylate, upon completion of the treatment, before the recovery of the products freed from aryl halogens.

Another advantage of the process is that the byproducts formed, such as the chloride NaCl, the aryl halogenated products converted by the alcoholate and the remaining unreacted alcoholate, can be easily destroyed by incineration without giving rise to toxic materials.

In order to further illustrate the present invention and the advantages thereof, the following specific examples are given, it being understood that same are intended only as illustrative and in nowise limitative.

EXAMPLE 1

1000 g of dibenzyl toluene (DBT) containing 300 ppm of aromatic chlorine in the form of monochlorobenzyltoluene were employed as the starting material. This mixture was placed in a reactor fitted with a rotary stirrer, a reflux condenser and a nitrogen injector. After purging with a stream of nitrogen at 100° C. for 15 minutes, 1% by weight (i.e., 10 g) of sodium methylate was added. The mixture was heated at 285° C. under stirring and nitrogen purging for 3 hours. The product was then distilled, vacuum being applied progressively, down to 2 mm of mercury such as not to exceed 300° C. in the heel section. the distillate obtained had a total aromatic chlorine content of 3 ppm.

By way of comparison, when the same product containing the same chlorinated products was treated with sodium carbonate, a product which had a total aromatic chlorine content on the order of 100 ppm was obtained.

EXAMPLE 2

DBT was treated as in Example 1, but with $NaOC_2H_5$, $KOCH_3$, $KOC_2H_5$ and $NaOCH(CH_3)_2$, and under the conditions of Example 1. The results are reported in the Table which follows.

EXAMPLE 3

(a) DBT containing 1000 ppm of PCB was treated with 1% of sodium methylate for 3 hours at 280° C. A product containing less than 15 ppm of chlorine was obtained.

(b) Identical with (a), except that the DBT contained 1000 ppm of tetrachlorobenzyltoluene.

The results are reported in the Table which follows.

EXAMPLE 4

(a) A mineral oil containing 1000 ppm of PCB was treated with 1% of $CH_3ON_a$ for 3 hours at 280° C. A product containing less than 15 ppm of halogen was obtained.

(b) Identical with (a), except that the mineral oil contained 1000 ppm of octabromobiphenyl.

The results are also reported in the Table which follows.

EXAMPLE 5

1600 g of DBT and 32 g of sodium methylate were placed in a reactor fitted with a rotary stirrer, a condenser and a nitrogen injector. The mass was heated (290° C.) under a nitrogen purge and with stirring. The nitrogen stream was then terminated and the condenser outlet was connected to a vessel containing water. After treatment for 70 hours at 290° C., no gas release was observed. After cooling and filtration, the reaction mixture showed:

(i) that there was no sign of light products in the filtrate, according to chromatographic analysis, and (ii) that the infrared spectrum on the solids, after washing with monochlorobenzene and with hexane and after drying in the absence of air (weight collected=95% of the weight of methylate employed), was precisely that of sodium methylate.

TABLE

| Nature of the product treated | Alcoholate employed | Weight content of halogen in the treated and distilled product |
|---|---|---|
| EXAMPLE 2 | | |
| DBT + 300 ppm of chlorine | 1% $C_2H_5ONa$ | <15 ppm |
| in the form of monochloro- | 0.5% $CH_3OK$ | <15 ppm |
| benzyltoluene | 0.5% $C_2H_5OK$ | <15 ppm |
| | 0.5% $(CH_3)_2$ CHONa | 37 ppm |
| EXAMPLE 3 | | |
| DBT + 1000 ppm of PCB (6.5 chlorines) | | |
| DPT + 1000 ppm of | 1% $CH_3ONa$ | <15 ppm |
| tetra- | | |
| chlorobenzyltoluene | 1% $Ch_3ONa$ | <15 ppm |
| EXAMPLE 4 | | |
| Mineral oil + 1000 ppm of PCB 6.5 chlorines* | 1% $CH_3ONa$ | <15 ppm |
| mineral oil + 1000 ppm of octabromobiphenyl** | 1% $CH_3ONa$ | <15 ppm |

*Determination of 580 ppm of chlorine in the form of chloride in the distillation residue, relative to the quantity of oil employed.

**Determination of 846 ppm of bromine in the form of bromide in the distillation residue, relative to the quantity of oil employed.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for dehalogenating a halogenated organic species, comprising contacting such species with a stoichiometric excess, relative to the halogen content thereof, of at least one alkali metal alcoholate, at a temperature greater than 220° C., while maintaining at least some of the alcoholate in suspension, thus forming a heterogeneous reaction media and recovering a dehalogenated organic species by distillation of said reaction media in the presence of excess alkali metal alcoholate.

2. The process as defined by claim 1, said at least one alcoholate comprising sodium, lithium or potassium methylate, ethylate, propylate or isopropylate.

3. The process as defined by claim 2, said at least one alcoholate comprising sodium methylate.

4. The process as defined by claim 1, said halogenated organic species comprising a chlorine- and/or bromine-substituted aryl compound.

5. The process as defined by claim 4, said aryl compound comprising a benzyltoluene, triphenylmethane, or higher homolog thereof.

6. The process as defined by claim 4, said aryl compound comprising a PCB, dioxin or debenzofuran.

7. The process as defined by claim 1, said halogenated organic species comprising admixture thereof with another organic material.

8. The process as defined by claim 1, carried out at a temperature of from 210° to 300° C.

9. The process as defined by claim 8, carried out at a temperature of from 250° to 290° C.

10. The process as defined by claim 1, said at least one alkali metal alcoholate comprising an anhydrous powder.

11. The process as defined by claim 1, carried out utilizing a 5 to 10 times stoichiometric excess of said at least one alkali metal alcoholate.

12. The process as defined by claim 1, carried out in the presence of an alkaline agent.

13. The process as defined by claim 13, said alkaline agent comprising sodium carbonate.

14. The process as defined by claim 1, wherein the reaction product comprises less than 10 ppm halogen content.

15. The process as defined by claim 7, said other organic material comprising a dielectric fluid.

16. A process for dehalogenating a halogenated organic species, comprising contacting such species with a stoichiometric excess, relative to the halogen content thereof, of at least one alkali metal alcoholate, at a temperature greater than 220° C. and in the absence of a solvent for the alcoholate to form a heterogeneous reaction medium, while maintaining at least some of the alcoholate is suspension, and recovering a dehalogenated organic species from said reaction medium in the presence of excess alcoholate.

17. A process for dehalogenating a halogenated organic species, comprising contacting such species with a stoichiometric excess, relative to the halogen content thereof, of at least one alkali metal alcoholate, at a temperature greater than 220° C., and recovering a dehalogenated organic species by distillation in the presence of excess alkali metal alcoholate, while maintaining at least some of the alcoholate in suspension, wherein said alkali metal alcoholate is added in the absence of a solvent for the alcoholate.

* * * * *